US008870999B2

(12) United States Patent
Wang et al.

(10) Patent No.: US 8,870,999 B2
(45) Date of Patent: Oct. 28, 2014

(54) APPARATUS AND METHOD FOR DEGASSING CAST ALUMINUM ALLOYS

(75) Inventors: Qigui Wang, Rochester Hills, MI (US); Hengcheng Liao, Nanjing (CN); Lei Zhao, Nanjing (CN); Ye Pan, Nanjing (CN)

(73) Assignee: GM Global Technology Operations LLC, Detroit, MI (US)

( * ) Notice: Subject to any disclaimer, the term of this patent is extended or adjusted under 35 U.S.C. 154(b) by 258 days.

(21) Appl. No.: 13/289,137

(22) Filed: Nov. 4, 2011

(65) Prior Publication Data

US 2013/0112042 A1 May 9, 2013

(51) Int. Cl.

| | |
|---|---|
| ***C22B 9/16*** | (2006.01) |
| ***C22B 9/04*** | (2006.01) |
| ***B22D 41/01*** | (2006.01) |
| ***B22D 41/08*** | (2006.01) |
| ***B22D 1/00*** | (2006.01) |
| ***B22D 41/005*** | (2006.01) |
| ***C22C 1/00*** | (2006.01) |

(52) U.S. Cl.

CPC ..... *B22D 1/00* (2013.01); *B22D 41/005* (2013.01); *B22D 41/08* (2013.01); *C22B 9/04* (2013.01); *C22B 9/16* (2013.01); *C22C 1/00* (2013.01)

USPC ..... 75/414; 266/242; 266/216; 266/217; 266/208

(58) Field of Classification Search

CPC ..... C22B 9/04; C22B 9/20; B22D 27/045; B22D 7/00

USPC ..... 75/414

See application file for complete search history.

(56) References Cited

U.S. PATENT DOCUMENTS

| | | | | |
|---|---|---|---|---|
| 3,240,588 | A * | 3/1966 | Finkl | 75/10.16 |
| 3,303,019 | A * | 2/1967 | Jacobs | 75/679 |
| 3,754,592 | A * | 8/1973 | Mullen | 164/122.1 |
| 3,998,264 | A * | 12/1976 | Hocking | 164/513 |
| 2002/0083571 | A1 * | 7/2002 | Lee et al. | 29/527.5 |
| 2009/0065354 | A1 * | 3/2009 | Kardokus et al. | 204/298.13 |

OTHER PUBLICATIONS

Zhao et al. Materials Letters, 2012, vol. 66, p. 328-331. Available online on Sep. 10, 2011.*

Hashimoto et al. Materials Transactions, JIM, 1994, vol. 35, p. 262-265.*

Poirier, et al., A Thermodynamic Prediction for Microporosity Formation in Aluminum-Rich Al—Cu Alloys, Metallurgical Transactions A, vol. 18A, Nov. 1980, pp. 1987-1979, Tucson, Arizona, USA.

Han, et al., Hydrogen Evolution during Directional Solidification and Its Effect on Porosity Formation in Aluminum Alloys, Metallurgical and Materials Transactions A, vol. 33A, Jul. 2002, pp. 2067-2072, Oak Ridge, Tennessee, USA.

(Continued)

*Primary Examiner* — Roy King
*Assistant Examiner* — Xiaowei Su
(74) *Attorney, Agent, or Firm* — Dinsmore & Shohl LLP

(57) ABSTRACT

A ladle that can melt and freeze castable metal in a specific manner so that high quality liquid metal and metal alloys may be produced with minimum oxide and hydrogen content. Upon introduction of a quantity of molten metal into the ladle, staged heating and cooling of the molten metal promotes the liberation of previously-dissolved gases from the castable metal, resulting in significant decreases in as-cast porosity.

10 Claims, 5 Drawing Sheets

(56) References Cited

OTHER PUBLICATIONS

Samuel, et al., Various Aspects Involved in the Production of Low-Hydrogen Aluminium Castings, Journal of Materials Science, vol. 27, 1992, pp. 6533-6563, Quebec, Canada.

Carpenter, et al., Efficiency Modeling of Rotary Degasser Head Configurations and Gas Introduction Methods, Part I—Water Tank Tests, Blasch Precision Ceramics, pp. 1-4, Albany, New York, USA.

Wu, et al., Effects of Spray Degassing Parameters on Hydrogen Content and Properties of Commercial Purity Aluminum, Materials Science and Engineering A, vol. 456, 2007, pp. 386-390, China.

Xu, et al., Effects of Ultrasonic Vibration on Degassing of Aluminum Alloys, Materials Science and Engineering A, vol. 473, 2008, pp. 96-104, Knoxville, Tennessee, USA.

Kashyap, et al., Effects and Mechanisms of Grain Refinement in Aluminium Alloys, Bulletin of Material Science, vol. 24, No. 4, Aug. 2001, pp. 345-353, Bangalore, India.

* cited by examiner

APPARATUS AND METHOD FOR DEGASSING CAST ALUMINUM ALLOYS

FIELD OF THE INVENTION

The present invention relates to the manufacturing of cast aluminum components and, more particularly, to methodologies and technologies to reduce gases, mainly hydrogen content, in liquid aluminum, and thus porosity in cast aluminum components after solidification.

BACKGROUND TO THE INVENTION

Porosity has long been recognized as one of the major casting defects affecting mechanical properties, especially fatigue performance, of cast components. Porosity forms due to volume shrinkage from liquid to solid during solidification, and, in particular, due to the evolution of the dissolved gases as a result of the significant decrease in solubility of the gases in the solid as compared to the liquid metal. Hydrogen is the only gas that is appreciably soluble in molten aluminum. (See Q. Han, S. Viswanathan, Metallurgical and Materials Transactions A, 33 (2002) 2067-2072; and D. R. Poirier, K. Yeum, A. L. Maples, Metall Trans A, 18 (1987) 1979-1987.). Thus, reducing or eliminating the dissolved hydrogen in molten Al helps to produce high quality castings.

There are several methods that are currently employed to reduce inclusion and hydrogen content in liquid aluminum. These methods include rotary impeller degassing using nitrogen, argon, or a mixture of the inert gases and chlorine as a purge gas; tablet degassing (such as hexachloroethane ($C_2Cl_6$) tablets); vacuum degassing; ultrasonic degassing; and spray degassing. (See A. M. Samuel, F. H. Samuel, J Mater Sci, 27 (1992) 6533-6563; A. C. Kevin., J. H. Michael, Light Metals, (2001) 1017-1020; R. Wu, Z. Qu, B. Sun, D. Shu, Materials Science and Engineering: A, 456 (2007) 386-390; and H. Xu, Q. Han, T. Meek, Materials Science and Engineering: A, 473 (2008) 96-104). Although the existing degassing methods have demonstrated effectiveness to varying degrees in refining Al melts, they can cause environmental problems (for example, due to $Cl_2$ gas release) or involve significant capital investment.

SUMMARY OF THE INVENTION

The present invention provides a degassing system that can melt and freeze cast metal and metal alloys in a specific manner so that high quality liquid metal and metal alloys (with minimum oxides and hydrogen content) may be produced. Methods of making high quality liquid metal and metal alloys are also described.

According to a first aspect of the invention, a method of degassing a metal or metal alloy is disclosed. The method includes filling a vessel with liquid metal or metal alloy, cooling the liquid metal or metal alloy in the vessel from the bottom of the vessel to the top of the vessel until the metal or metal alloy transitions from a liquid state to a solid state, after which it is heated above the liquidus temperature of the metal or metal alloy from the top of the vessel to the bottom of the vessel. In this way, degassing and reduction of oxides and related dissolved substances is promoted by just freezing and melting the metal or metal alloy one or more times.

In one optional form, the vessel is a pour ladle, while in another, it is a furnace. In another option, the proposed method may be used in either controlled (i.e., closed) or normal air (i.e., open) environments. The method may further include applying a vacuum while the metal or metal alloy is being cooled and heated. Additionally, the pour ladle includes a lid and vacuum valve that cooperate to form a vacuum inside the ladle during at least a portion of the time the molten metal is present therein. The pour ladle may be configured to include an aperture in its bottom, where the aperture can be selectively closed off, such as by a moveable stopper that can be controlled by an appropriate actuation mechanism. In a preferred form, the cooling and heating steps may be repeated as often as necessary to get the porosity to within a predetermined threshold. The method may additionally include adding grain-refining agents such as TiBor, eutectic-refining agents such as Al-10% Sr, or related additives to the pour ladle before filling; such a pour ladle may have a lid with a valve such that the valve is opened to facilitate the adding of such grain-refining and eutectic-modifying agents (which may be, for example, in segmented bar form), after which the valve is closed against the lid. The liquid metal or metal alloy is preferably cooled with a cooling unit positioned at or near the bottom of the pour ladle, whereas reheating of the cooled metal or metal alloy may be achieved by a zone-controlled heater or heating unit positioned on the pour ladle somewhere above the cooling unit. In this way, the molten metal or metal alloy received into the ladle is cooled from the bottom-up and reheated from the top-down as a way to promote significant increases in porosity reduction. In particular, the bottom-up cooling approach allows for the continued degassing of any previously-dissolved hydrogen as the solidification of the molten metal proceeds in an upward pattern. The heating unit and the cooling unit may be configured as part of a thermal management unit or system. Additional options may be employed for energy saving. For example, more precise control over the operation of the cooling unit and the heating unit avoids overcooling or overheating (both of which involve expending more energy than necessary to achieve the desired freezing or melting). In a particular form, the cooling unit can be used to achieve a metal temperature of about 10° C. below the solidus temperature, while the heating unit can be used achieve a metal temperature of about 20° C. above the solidus temperature.

According to another aspect of the invention, a ladle used in a metal casting operation includes a container where heating and cooling of the molten metal within the ladle is achieved by a cooling unit and a heating unit. In a particular form, the cooling unit and heating unit cooperate to provide alternate freezing (i.e., solidifying) and re-melting of the molten metal being introduced into the ladle. As discussed above in the previous aspect, the nature of the heating and cooling units is such that cooling of the molten metal within the ladle's container takes place in a bottom-up fashion. Such a configuration takes advantage of the fact that the solubility of hydrogen, oxides or other impurities (which are a significant contributor to as-cast porosity) is dramatically higher in the liquid or molten state relative to the solid state. In this way, the initial cooling, by virtue of starting at or near the bottom of the molten metal contained within the ladle, tends to force the less dense gaseous impurities that is becoming less soluble in the portion of the metal being solidified (hardened) by the cooling to take a vertically-upward path through the as-yet unsolidified molten portion. Thus, the impurities that drop out of solution continue their upward path until a substantial entirety of them have been degassed. By the time that a substantial entirety of the metal contained within the ladle has solidified, most (or all) of the hydrogen (or other gaseous impurities) that was previously held within the molten metal has been liberated. Thus, when cooling in a bottom-up manner, the gas bubbles rejected from the solidifying melt at the bottom portion can freely flow out through the top since the top is still in liquid state. Likewise, the heating of the metal (once cooled by the cooling unit) may take place in a top-down fashion to promote longer furnace or ladle life, as well as to further enhance degassing. This occurs because as the metal volume expands when it changes from solid to liquid, the expanded volume at the bottom can damage the furnace, ladle or related container if the top is still in solid state and also sticks to the furnace or ladle wall; by employing top-down melting, the gas bubbles, if still present, can also flow to the top and escape away from the molten metal.

As before, optional ladle configurations may be employed, including bottom-loading, one or more apertures for the introduction of the molten metal, as well as other features, may be included. For example, the heating unit may be a zone-controller heater that permits a staged introduction of heat to the metal container in the ladle. In another form, the container defines an aperture formed therein. In a preferred form, the aperture is at or near the bottom of the ladle, while a stopper, valve or related closure mechanism can be used to provide closure of the aperture. In another option, the container is enclosable to permit the formation of a vacuum within the container. Various valves may be used to establish not only aperture closure, but also selective access to other parts of the container. One such valve may be a rotary ball valve to permit the selective introduction of one or more of the aforementioned grain-refining and eutectic-modifying agents into the molten metal that is resident in the container. Other access features, such as a fill nozzle connected to a fill pipe and a purging gas valve, may be used to permit the selective fluid communication of a purging gas into the container.

According to another aspect of the present invention, a molten metal degassing system includes a ladle and a thermal management unit. Upon introduction of the molten metal (where such molten metal is a precursor to a cast metal finished product) into the ladle, the thermal management unit provides cooling and heating of the metal in order to provide solidification (by the cooling) and subsequent melting (by the heating) in such a manner that the expulsion or related liberation of gaseous components previously dissolved in the metal takes place in an upwardly-directed manner through the portion of the metal that has yet to have solidified. The frozen metal (which now has a substantially-reduced dissolved gas content) may then be melted to promote introduction of the metal into a casting mold, casting cavity or related structure. This cooling and heating sequence may be repeated as often as needed until a suitably low level of porosity is achieved. In a preferred form, the thermal management unit includes the cooling and heating units as previously described. Preferably, the cooling unit is situated beneath the heating unit so that when the molten metal is first cooled, such cooling (and concomitant solidification) occurs in an upwardly-directed manner in order to more thoroughly expel the gaseous components (such as hydrogen) that may be dissolved into the metal while the metal is in its liquid state. Upon solidification of the substantial entirety of the metal by the cooling unit, the heating unit may re-melt the metal (which now has a substantially-reduced dissolved gas component content) such that the re-melted metal may be transferred to a casting mold or (in the case of where further dissolved gas removal is required) operated upon again by the combined cooling and heating units.

Optionally, the degassing system includes a lid coupled to the ladle to form an enclosed structure between them. An evacuation unit may be fluidly coupled to the ladle to draw a vacuum; such vacuum helps remove the expelled gaseous components from the region in the ladle above the molten metal. The degassing system may additionally include a grain-refiner and eutectic-modifier introduction mechanism cooperative with the ladle, as well a purging mechanism to permit the selective introduction of a purging fluid into the enclosed structure.

BRIEF DESCRIPTION OF THE DRAWINGS

The following detailed description of specific embodiments can be best understood when read in conjunction with the following drawings, where like structure is indicated with like reference numerals and in which:

FIG. 3B shows the same alloy after re-melting once and FIG. 3C shows the same alloy after re-melting twice;

FIG. 4B shows the same alloy after re-melting once and FIG. 4C shows the same alloy after re-melting twice;

FIG. 5B shows the same alloy after re-melting once and FIG. 5C shows the same alloy after re-melting twice.

DETAILED DESCRIPTION OF THE INVENTION

The present invention reduces the hydrogen content in liquid metals and alloys without using separate degassing equipment. It improves casting quality and melt treatment efficiency. It also reduces capital investment and repair costs.

Figure 1:
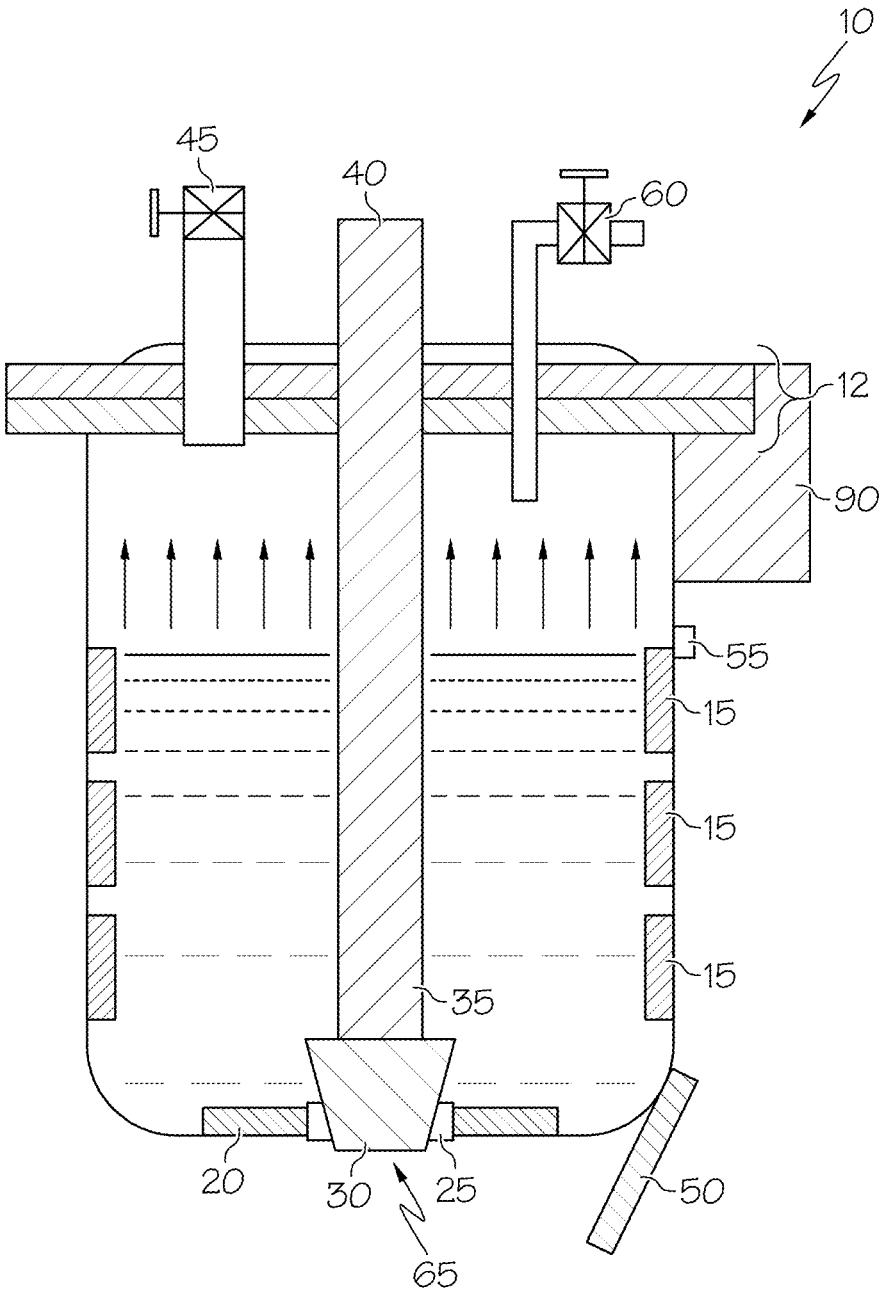
FIG. 1 is an illustration of one embodiment of an apparatus which can be used in the present invention.

Casting and related foundry operations rely upon a ladle or related vessel or container to transport and pour molten metals. One embodiment of an apparatus that can be used in the present invention is shown in FIG. 1, where a degassing/pour ladle (also called a pour ladle, pouring ladle or more simply, ladle) 10 includes a zone-controlled heater (or heating unit) 15 on the side of the pour ladle, and a cooling unit 20 on or near the bottom (for example, within about 10 mm of the bottom). As shown, the heating unit 15 may be configured from individually-staged or controlled heating elements. By using a suitable controller, the heating elements may be operated as either a whole or as individual elements to facilitate the desired heating pattern. The zone-controlled heater 15 and cooling unit 20 control the metal or metal alloy temperature in the pour ladle, and together make up a staged thermal management unit. It will be appreciated by those skilled in the art that the precise nature of zone-controlled heating and cooling can be varied, providing that it is capable of providing a heating or cooling pattern commensurate with the degassing needs of the metal alloy as set forth herein. As mentioned above, control of the heating and cooling operations employing the heating unit 15 and cooling unit 20 may be achieved by a controller (not shown) which may be equipped with a central processing unit (CPU), and content-addressable memory (for example, in the form of read-only memory (ROM) for storing a program which controls the operation of the overall apparatus, and a random-access memory (RAM) having a data storage area). The CPU is connected to an input/output interface (which may perform one or both of discrete and analog input and output), while additional signal-processing apparatus, such as an analog-to-digital (A/D) converter and one or more filter circuits. Such a controller may function as a digital signal processor, an application specific integrated circuit, a field programmable gate array, any suitable programmable logic device, discrete gate or transistor logic, discrete hardware components, or any combination thereof. In one preferred form, the controller is configured to instruct the thermal management unit how to stage its cooling and heating sequences, as well as to repeat the solidifying and re-melting sequences as often as necessary in order to achieve a desired level of porosity reduction.

An aperture 25 is situated at the bottom of the ladle 10 to permit the selective introduction of molten metal therein; such a configuration is often referred to as a bottom-pour ladle. A stopper 30, which is connected by a stopper rod 35 to a stopper actuator 40, can be manipulated to close aperture 25 in response to an appropriate control signal (not shown). In one form, the stopper 30 can be made to engage aperture 25 through rotation of stopper rod 35, which in one form rotates about a quarter of a turn between opening and closing.

During operation, the ladle 10 is filled with liquid metal when the ladle 10 is dipped into the liquid metal (which may be resident in a holding furnace or related container) with the aperture 25 open, after which the aperture 25 is closed with the stopper 30 to prevent the captured liquid metal from leaking from the aperture 25 when the ladle 10 is moved away from the holding furnace. A valve 45 is located in a cover lid 12; when the valve 45 is opened, one or more of grain refiners such as TiBor (Al—Ti—B) bars and eutectic modifiers such as Al-10% Sr bars may be introduced into the molten metal contained within ladle 10 to provide grain size refinement and eutectic modification for reduced shrink porosity. Within the present context, grain refiners and eutectic modifiers may be used together in aluminum casting to refine the microstructure for better mechanical properties. Rotary ball valves are desirable because the inert gas in the pour ladle can be sealed while adding the grain refiner and eutectic modifier; nevertheless, any valve type providing comparable sealing may be used. In this form, the valve 45 (as well as any ancillary structure) may act as an introduction mechanism for a grain-refiner and a eutectic modifier. The lid 12 helps promote an enclosed structure between it and the body of the ladle 10 such that a vacuum may be pulled and maintained in the space between the top of the molten metal and the lid 12. The use of a vacuum source and associated piping, valves, seals and related equipment is referred to as an evacuation unit; because the principles relating to the operation of such a unit are well-understood, they will not be discussed in further detail.

During operation, ladle 10 is positioned under a device that provides grain refiner and eutectic modifier rods which, in a preferred form as mentioned above are provided in pre-cut lengths. Introduction of the rods could be through any suitable feed mechanism (not shown). After the valve 45 is opened, and the grain refiner and eutectic modifier rods drop into the ladle 10. Once the appropriate number of grain refiner and eutectic modifier rods are placed in the ladle 10, the valve 45 is closed, and the ladle 10 moves to the (holding) furnace. When the ladle 10 is positioned at the furnace, the ladle 10 is dipped down until a dross skimmer 50 is immersed about 10 mm to about 50 mm in the liquid metal. The ladle 10 is moved in one direction to skim the dross away with the skimmer 50. After the dross is skimmed, the system cycles the stopper actuator 40 to make about one quarter of a turn of the stopper 30 and the stopper rod 35 to the open position. In a preferred form, robotic control (not shown) may be used to move the ladle 10 and related equipment relative to the various furnaces and other metal-processing equipment in a conventional manner. In particular, a robot gradually plunges the ladle 10 into the liquid metal or metal alloy until an external contact probe 55 touches the metal or metal alloy, grounding a circuit which instructs the robot to cease its movement, at which time the aperture 25 is closed with the stopper 30, and the ladle 10 is lifted out of the dip well within the furnace.

The cooling unit 20 starts to freeze the liquid metal gradually from the bottom to the top in the ladle 10. At the same time, a vacuum valve 60 is opened to pull a vacuum at the metal surface. When the metal temperature is cooled to a suitable temperature (for example, between about 10° C. and about 50° C. below the solidus of the alloy), the cooling unit 20 stops. Because higher amounts of energy are needed to re-melt the metal when the metal is cooled to a lower temperature, it is preferable to minimize the cooling as much as possible (for example, to no more than about 10° C. below the solidus of the alloy. The time needed for cooling will depend on the amount of material being processed and the temperature to which it is cooled.

Once the cooling has been substantially halted, the zone-controlled heater 15 starts to work so that the metal gradually melts from the top in a downward direction. The time for re-melting will depend on the amount of material being processed and the temperature to which it is re-melted. When the liquid metal reaches a suitable temperature (for example, between about 10° C. and about 50° C. above the liquidus) the zone-controlled heater 15 stops. As mentioned above, using a minimum temperature is desirable to avoid excess energy use for re-melting; for example, within the range discussed above, about 10° C. above the liquidus of the alloy would be a preferred amount of heating. The cooling and heating steps discussed above completes one re-melting cycle. To get a better degassing result, the above procedure may be repeated one or more times.

Prior to pouring the liquid metal into a casting mold (not shown), the liquid metal temperature may be raised to any specific pouring temperature. When the liquid metal temperature reaches the pouring temperature, the system moves the ladle 10 to the top of a pouring basin (not shown) in the casting mold. After the ladle 10 is positioned, the system cycles the stopper actuator 40 to make about one quarter of a turn of the stopper 30 and the stopper rod 35 to the open position to pour the liquid metal to the pouring basin. After the casting is poured, the aperture 25 is closed with the stopper 30, and the ladle 10 is lifted for the next cycle. A flange 90 may be used by a robot or other automated equipment to hold ladle 10 during its transport through the casting process.

Figure 2:
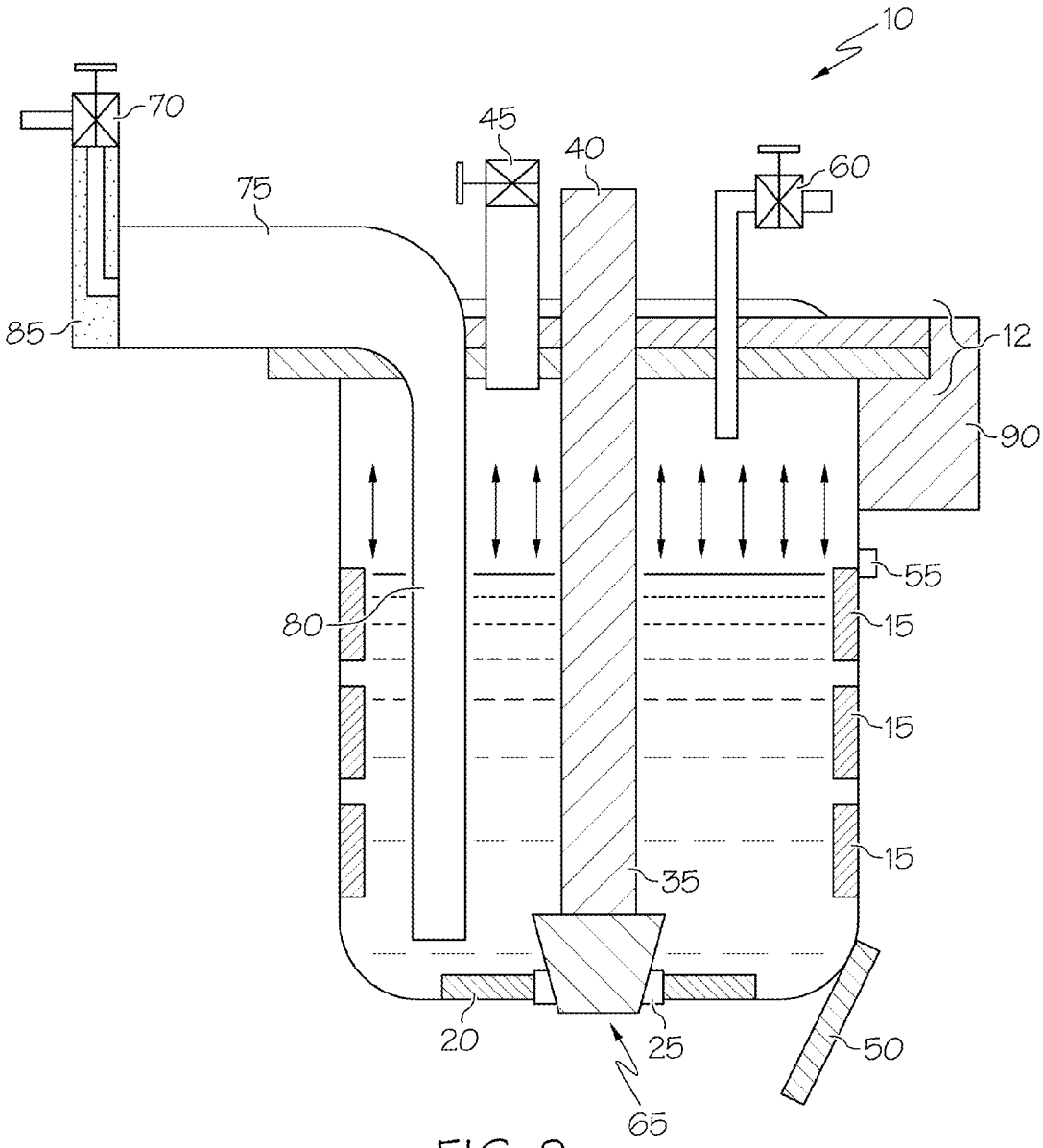
FIG. 2 is an illustration of another embodiment of an apparatus which can be used in the present invention.

FIG. 2 illustrates another embodiment of the ladle 10, where lid 12 is modified to accommodate purging gas equipment. The zone-controlled heater 15 and cooling unit 20 control the metal temperature in a manner similar to that discussed above, as does the cooperative action of the stopper 30, aperture 25 and stopper actuator 40. In the present embodiment, the extra equipment (collectively referred to as a purging mechanism) promotes the use of a purge gas to help degas the molten metal. A purging gas valve 70 allows (when open) the introduction of inert gas into a subsurface metal fill nozzle 75 and fill pipe 80 during times when such pipe 80 is empty (for example, when neither filling nor casting). The fill pipe 80 and fill nozzle 75 are used for a low pressure fill of a casting cavity or related mold (not shown) to make the casting component to minimize oxide generation during mold fill. As with the embodiment depicted in FIG. 1, the ladle 10 is positioned under a device or unit that provides pre-cut lengths of grain refiner such as TiBor and eutectic modifier (such as Al-10% Sr) rods from a feed mechanism, after which the valve 45 is opened to cause the grain refiner and eutectic modifier rods to drop into the ladle 10. After the valve 45 is closed, and the ladle 10 is moved to the holding furnace.

When the ladle 10 is positioned at the furnace, the ladle 10 is dipped down until the dross skimmer 50 is immersed about 10 mm to about 50 mm into the liquid metal. The ladle 10 is moved in one direction to skim the dross away with the skimmer 50. After the dross is skimmed, the aperture 25 is opened. From this, the ladle 10 is gradually plunged into the metal until external contact probe 55 touches the metal, grounding a circuit to stop additional movement of ladle 10. After certain amount of melt is filled into the ladle, the aperture 25 is closed and the ladle 10 is lifted out of the dip well. The cooling unit 20 starts to freeze the liquid metal gradually from the bottom to the top in the ladle 10 in a manner similar to that discussed above, while the vacuum valve 60 is opened to pull a vacuum at the metal surface. When the metal is cooled to a temperature at least about 10° C. below the solidus of the alloy, the cooling unit 20 stops, and the zone-controlled heater 15 starts to work so that the metal gradually melts from the top to the bottom. When the liquid metal reaches a temperature at least about 10° C. above the liquidus of the alloy, the zone-controlled heater 15 stops.

When the liquid metal is ready to fill up a casting mold package, the ladle 10 is moved to the pouring station. Prior to pushing the fill nozzle 75 against the mold inlet (not shown), a purging gas cover 85 is moved to allow a secure connection between fill nozzle 75 and the mold inlet. At this time, vacuum valve 60 can be opened to act as a fill pressurization valve; this forces liquid metal to be pushed through fill pipe 80 and fill nozzle 75 to fill the mold cavity (not shown). In a variation (not shown) the fill pressurization function of vacuum valve 60 may be performed by a separate valve as an alternative to the single valve 60 shown, where (for example) a three position valve can be used, where one position is for connection to a vacuum pump (not shown), one for connection to a pressurized (inert) gas pump (not shown) and a third position for valve closure. After the mold is filled, valve 60 is closed, after which robotic movement of the ladle 10 away from the casting mold is activated. Meanwhile, the purging gas cover 85 may be closed to seal off the fill nozzle 75, while purging gas valve 70 is opened to purge the ladle 10 with incoming inert gas, making the ladle 10 ready for the next cycle.

EXAMPLES

Figure 3A:
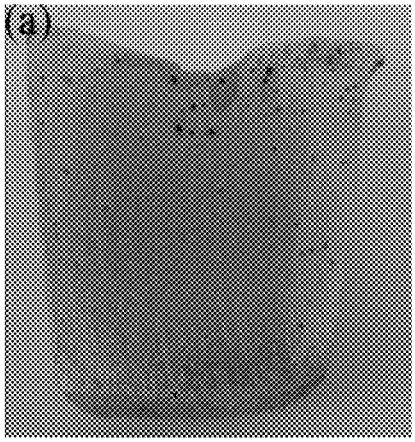
FIGS. 3A through 3C are photographs showing the porosity levels in a pure aluminum alloy, where FIG. 3A specifically shows such levels without any re-melting.
Figure 3B:
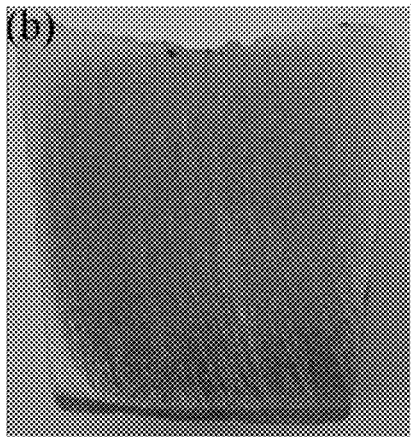
Figure 3C:
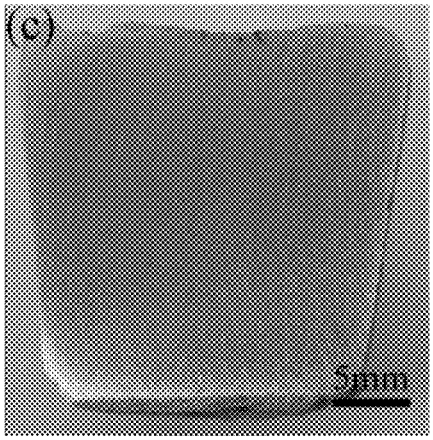
Figure 3D:
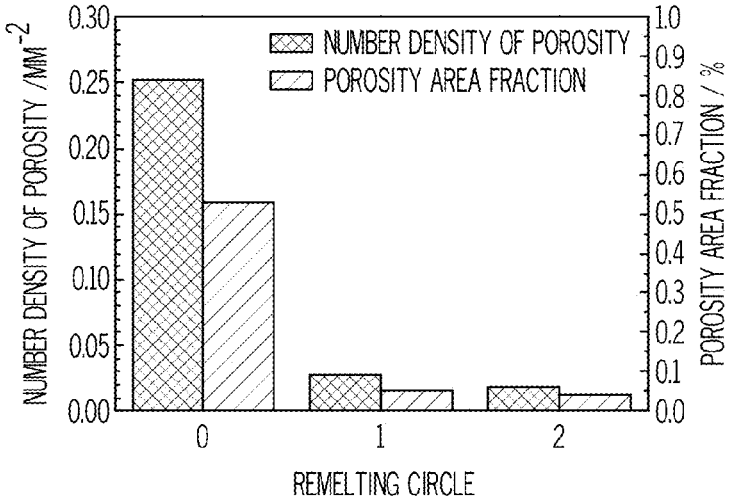
FIG. 3D is a graph showing the quantitative data of area fraction and number density of porosity of the respective approaches of FIGS. 3A through 3C.
Figure 4A:
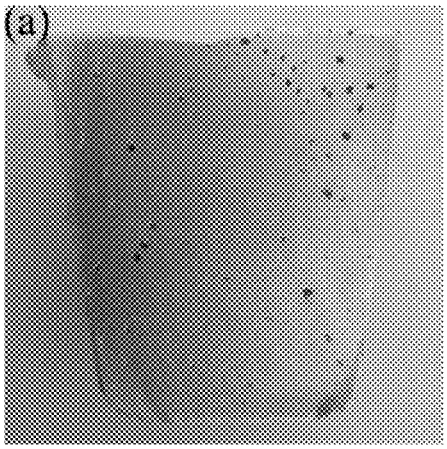
FIGS. 4A through 4C are photographs showing the porosity levels in a near eutectic (Al-13% Si) aluminum-silicon alloy where FIG. 4A specifically shows such levels without any re-melting.
Figure 4B:
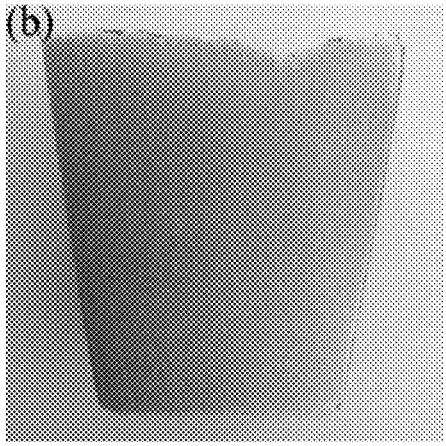
Figure 4C:
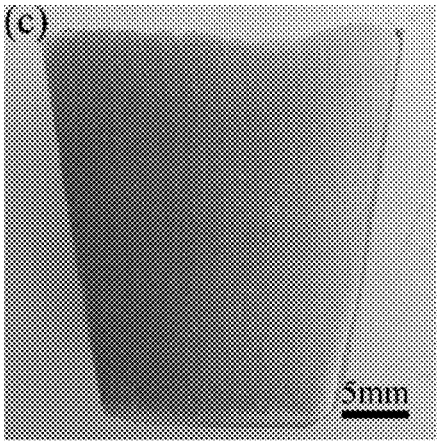
Figure 4D:
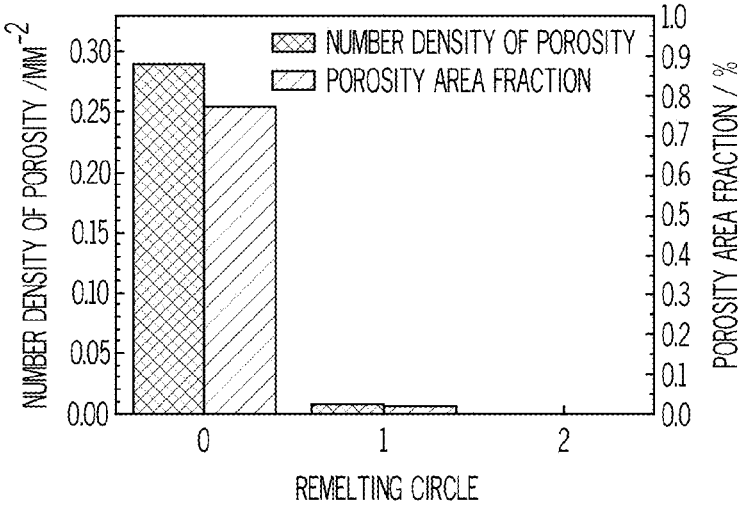
FIG. 4D is a graph showing the quantitative data of area fraction and number density of porosity of the respective approaches of FIGS. 4A through 4C.
Figure 5A:
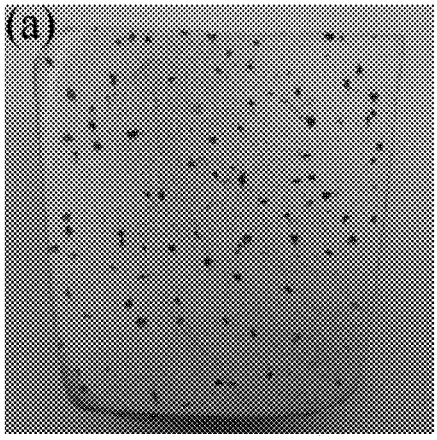
FIGS. 5A through 5C are photographs showing the porosity levels in hypoeutectic (Al-7% Si) aluminum-silicon alloy where FIG. 5A specifically shows such levels without any re-melting.
Figure 5B:
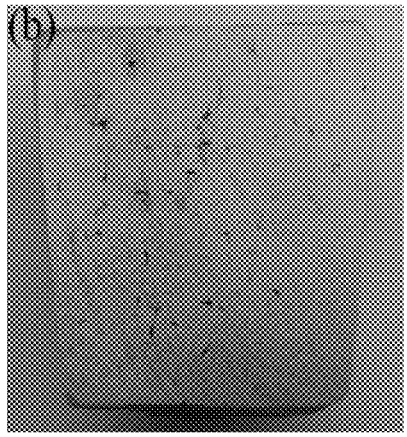
Figure 5C:
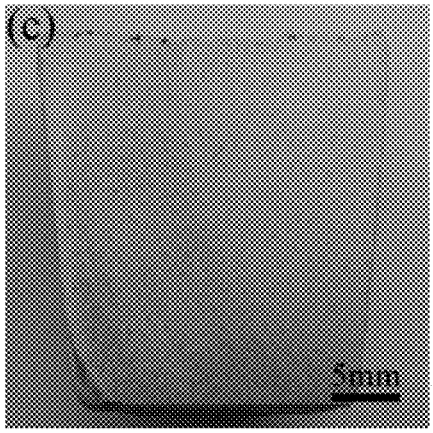
Figure 5D:
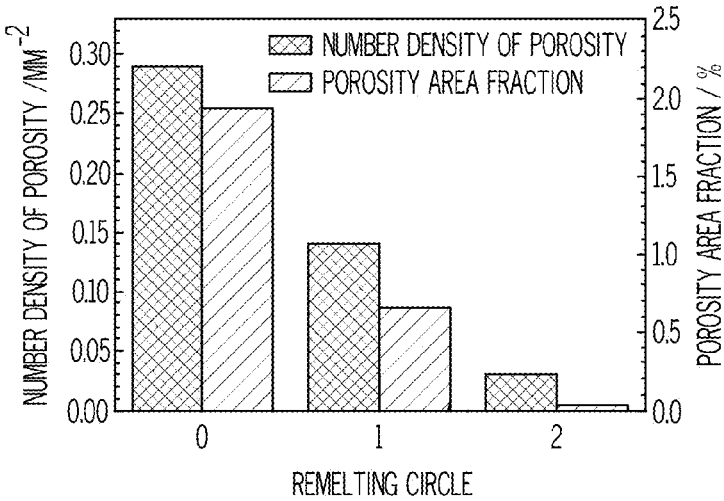
FIG. 5D is a graph showing the quantitative data of area fraction and number density of porosity of the respective approaches of FIGS. 5A through 5C.

FIGS. 3A through 3C show the resulting porosity levels on a vertical section of pure aluminum specimens with (FIGS. 3B and 3C) and without (FIG. 3A) re-melting. FIG. 3D is a graph illustrating the number density and area fraction of porosity measured for the results depicted in FIGS. 3A through 3C. Without re-melting, the sample has a high level of pores (about 0.25 pore per square millimeter) dispersed throughout the metal matrix (FIG. 3A). After re-melting once according to the present invention, the porosity level decreased dramatically, where only 11 pores (with a porosity number density of about 0.01 pore per square millimeter) were left on the top of the sample (FIG. 3B). After re-melting twice, even fewer pores were present (FIG. 3C), likely because they stuck to the surface oxide films. This indicates that re-melting can result in a very efficient degassing.

A similar result has also been shown in FIGS. 4A through 4D for a near eutectic Al—Si alloy. After re-melting once, both the number density and area fraction of porosity dropped down remarkably from 0.29 pore per square millimeter to 0.007 pore per square millimeter (with a related volume fraction of porosity dropping from 0.77% to 0.02%). After re-melting twice, a substantial entirety of the pores disappeared.

The positive influence of the re-melting process of the present invention on degassing is also shown with a hypoeutectic A356 (Al-7% Si) alloy in FIGS. 5A through 5D. After the first re-melting, the morphology of pores changed from approximately round (FIG. 5A) to worm-like (FIG. 5B); such changes exhibit a typical characteristic of shrinkage. After the second re-melting (FIG. 5C), almost all shrinkage pores disappear, implying that it is difficult for shrinkage pores to form when the hydrogen level and oxide inclusion are significantly reduced after re-melting.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "device" is utilized herein to represent a combination of components and individual components, regardless of whether the components are combined with other components. For example, a "device" according to the present invention may comprise an electrochemical conversion assembly or fuel cell, a vehicle incorporating an electrochemical conversion assembly according to the present invention, etc.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A method of casting an aluminium alloy comprising:

filling a pour ladle with a liquid hypoeutectic aluminum-silicon alloy;

cooling the liquid hypoeutectic aluminum-silicon alloy without the presence of an inerting gas in the ladle from the bottom of the ladle to the top of the ladle to a temperature below the solidus temperature of the hypoeutectic aluminum-silicon alloy in order to facilitate an upward migration of hydrogen gas within the hypoeutectic aluminum-silicon alloy;

heating the cooled hypoeutectic aluminum-silicon alloy to a temperature above the liquidus temperature of the hypoeutectic aluminum-silicon alloy from the top of the ladle to the bottom of the ladle such that any remaining hydrogen gas that was subject to upward migration is liberated as the hypoeutectic aluminum-silicon alloy liquifies;

applying a vacuum while the hypoeutectic aluminum-silicon alloy is being cooled and heated within the ladle;

pouring the liquified hypoeutectic aluminum-silicon alloy into a casting mold; and cooling the liquified hypoeutectic aluminum-silicon alloy to below its solidus temperature.

2. The method of claim 1, wherein the ladle comprises a lid with a vacuum valve such that the vacuum is applied using the vacuum valve.

3. The method of claim 1, wherein the ladle defines an aperture therein such that the filling takes place through the aperture.

4. The method of claim 3, further comprising selectively closing the aperture.

5. The method of claim 1, further comprising adding at least one of a grain-refining agent and a eutectic modifying agent to the ladle before filling the ladle.

6. The method of claim 5, wherein the ladle comprises a lid with a valve such that the valve is opened to facilitate the adding, after which the valve is closed against the lid.

7. The method of claim 1, wherein the liquid hypoeutectic aluminum-silicon alloy is cooled with a cooling unit placed in thermal communication with the bottom of the ladle.

8. The method of claim 7, wherein the cooled hypoeutectic aluminum-silicon alloy is heated with a zone-controlled heating unit placed in thermal communication with the side of the ladle.

9. The method of claim 1, further comprising repeating the cooling and heating steps.

10. The method of claim 1, wherein the cooling is to a temperature about 10° C. below the solidus temperature of the hypoeutectic aluminum-silicon alloy and the heating is to a temperature about 20° C. above the liquidus temperature of the hypoeutectic aluminum-silicon alloy.

* * * * *